US005863685A

United States Patent [19]

DeFeo et al.

[11] Patent Number: 5,863,685

[45] Date of Patent: Jan. 26, 1999

[54] ELECTROPHOTOGRAPHIC IMAGING MEMBER HAVING AN IMPROVED CHARGE TRANSPORT LAYER

[75] Inventors: Paul J. DeFeo, Sodus Point; John F. Yanus, Webster; Damodar M. Pai, Fairport; Andrew R. Melnyk, Rochester, all of N.Y.

[73] Assignee: Xerox Corporation, Stamford, Conn.

[21] Appl. No.: 914,565

[22] Filed: Aug. 19, 1997

[51] Int. Cl.[6] ..... G03G 5/047

[52] U.S. Cl. ..... 430/59; 430/132

[58] Field of Search ..... 430/58, 59, 130, 430/132

[56] References Cited

U.S. PATENT DOCUMENTS

| | | | |
|---|---|---|---|
| 4,621,009 | 11/1986 | Lad | 428/216 |
| 4,871,634 | 10/1989 | Limburg et al. | 430/54 |
| 4,983,481 | 1/1991 | Yu | 430/59 |
| 5,167,987 | 12/1992 | Yu | 427/171 |
| 5,385,796 | 1/1995 | Spiewak et al. | 430/131 |
| 5,413,810 | 5/1995 | Mastalski | 427/171 |
| 5,683,842 | 11/1997 | Duff et al. | 430/59 |
| 5,698,359 | 12/1997 | Yanus et al. | 430/132 |
| 5,728,498 | 3/1998 | Yanus et al. | 430/59 |

*Primary Examiner*—John Goodrow

[57] ABSTRACT

A flexible electrophotographic imaging member including a supporting substrate coated with at least one imaging layer including hole transporting material containing a hole transporting molecule dissolved or molecularly dispersed in a film forming binder and coated from a mixture of solvents including a low point boiling solvent and a small concentration of high boiling point solvent. Preferably, the flexible electrophotographic imaging member is free of an anticurl backing layer, the imaging member including a supporting substrate uncoated on one side and coated on the opposite side with at least a charge generating layer and a charge transport layer containing hole transporting material dissolved or molecularly dispersed in a film forming binder and coated from a mixture of solvents containing a low boiling point solvent and a small concentration of high boiling point solvent.

19 Claims, No Drawings

ELECTROPHOTOGRAPHIC IMAGING MEMBER HAVING AN IMPROVED CHARGE TRANSPORT LAYER

BACKGROUND OF THE INVENTION

This invention relates in general to electrophotography and, more specifically, to an electrophotographic or xerographic imaging member having a charge transport layer containing a hole transport small molecule dispersed in a film forming binder, the layer be formed from a coating solution comprising a high boiling and a low boiling solvent. In the art of xerography, a xerographic plate comprising a photoconductive insulating layer is imaged by first uniformly depositing an electrostatic charge on the imaging surface of the xerographic plate and then exposing the plate to a pattern of activating electromagnetic radiation such as light which selectively dissipates the charge in the illuminated areas of the plate while leaving behind an electrostatic latent image in the non-illuminated areas. This electrostatic latent image may then be developed to form a visible image by depositing finely divided electroscopic marking particles on the imaging surface.

A photoconductive layer for use in xerography may be a homogeneous layer of a single material such as vitreous selenium or it may be a composite layer containing a photoconductor and another material. One type of composite photoconductive layer used in electrophotography is illustrated in U.S. Pat. No. 4,265,990. A photosensitive member is described in this patent having at least two electrically operative layers. One layer comprises a photoconductive layer which is capable of photogenerating holes and injecting the photogenerated holes into a contiguous charge transport layer. Generally, where the two electrically operative layers are positioned on an electrically conductive layer with the photoconductive layer sandwiched between a contiguous charge transport layer and the conductive layer, the outer surface of the charge transport layer is normally charged with a uniform electrostatic charge and the conductive layer is utilized as an electrode. In flexible electrophotographic imaging members, the electrode is normally a thin conductive coating supported on a thermoplastic resin web. Obviously, the conductive layer may also function as an electrode when the charge transport layer is sandwiched between the conductive layer and a photoconductive layer which is capable of photogenerating electrons or holes and injecting the photogenerated electrons or holes into the charge transport layer. The charge transport layer in this embodiment, of course, must be capable of supporting the injection of photogenerated electrons from the photoconductive layer and transporting the electrons through the charge transport layer.

Various combinations of materials for charge generating layers and charge transport layers have been investigated. For example, the photosensitive member described in U.S. Pat. No. 4,265,990 utilizes a charge generating layer in contiguous contact with a charge transport layer comprising a polycarbonate resin and one or more of certain aromatic amine compounds. Various generating layers comprising photoconductive materials exhibiting the capability of photogeneration of holes and injection of the holes into a charge transport layer have also been investigated. Typical photoconductive materials utilized in the generating layer include amorphous selenium, trigonal selenium, and selenium alloys such as selenium-tellurium, selenium-tellurium-arsenic, selenium-arsenic, and mixtures thereof. The charge generation layer may comprise a homogeneous photoconductive material or particulate photoconductive material dispersed in a binder. Other examples of homogeneous dispersions of conductive material in binder charge generation layer are disclosed in U.S. Pat. No. 4,265,990. Additional examples of binder materials such as poly(hydroxyether) resins are taught in U.S. Pat. No. 4,439,507. The disclosures of the aforesaid U.S. Pat. No. 4,265,990 and U.S. Pat. No. 4,439,507 are incorporated herein in their entirety. Photosensitive members having at least two electrically operative layers as disclosed above in, for example, U.S. Pat. No. 4,265,990, provide excellent images when charged with a uniform negative electrostatic charge, exposed to a light image and thereafter developed with finely developed electroscopic marking particles.

If a flat, biaxially oriented polyethylene terephthalate (e.g. 3 mil thick PET) sheet is solvent coated with an imaging layer, for example a solution of 50 percent by weight polycarbonate (e.g. Makrolon) and 50 percent by weight aromatic diamine dissolved in a solvent to form a charge transport layer (CTL) about 1 mil thick, the multilayer structure tends to curl upon drying. This is due to the dimensional contraction of the applied (CTL) coating relative to the PET substrate from the point in time when the applied (CTL) coating solidifies and adheres to the underlying surface. The solidification point is the glass transition temperature (Tg) of applied coating. Once this solidification point is reached, further evaporation of coating solvent and/or cooling below Tg causes continued shrinking of the applied coating layer due to volume contraction resulting from removal of additional solvent and/or differential thermal contraction will cause the coated sheet to curl toward the applied layer because the PET substrate undergoes smaller dimensional changes. This relative contraction occurs isotropically, i.e., in three-dimensions. In other words, from the point in time when the applied coating has reached the Tg and is anchored at the interface with the underlying support layer, continued shrinking of the applied coating causes dimensional decreases in the applied coating which in turn builds up internal tension stress in the two dimensions constrained by adhesion to the substrate and, therefore, forces the entire coated structure to curl toward the dried applied coating. If the coated article has a circular shape, the curled structure will resemble a bowl. If the Tg of the coated CTL layer is about 50 degrees C above the operating temperature of the imaging member the relative shrinkage is about 0.6%.

Curling is undesirable for several reasons. First, because many of the electrophotographic imaging process depend critically on the spacing between the component and the imaging member; any variation in the flatness adversely affect the quality of the ultimate developed images. For example, non-uniform charging distances may be manifested as variations in the electrostatic latent images. Also the built-in stress weakens the adhesion between the layers, leading to adhesion failures. Moreover, the additional stress combined with the stress from constant flexing of multilayered photoreceptor belts during cycling can cause stress cracks to form due to fatigue and an earlier failure. These cracks print out on the final electrophotographic copy. Premature failure due to fatigue prohibits use of these belts in designs utilizing small roller sizes (e.g. 20 mm or smaller) for effective auto paper stripping. Note that the stretching of the coated layer on a 20 mm roll is approximately equal to 0.6% hence the stress is twice what it would be without the built in stress. In other words, flexing a belt with a built in 0.5% shrinkage stress on a 20 mm roll is equivalent to flexing an unstressed belt around a 12 mm roll.

The curl can be counteracted by applying a coating to the underside of the imaging member, i.e. the side of the supporting substrate opposite the electrically active layer or layers. However, such coating requires an additional coating step on a side of the substrate opposite from the side where all the other coatings are applied. This additional coating operation normally requires that a substrate web be unrolled an additional time merely to apply the anticurl layer. Also, many of the solvents utilized to apply the anti-curl layer require additional steps and solvent recovery equipment to minimize solvent pollution of the atmosphere. Further, equipment required to apply the anti-curl coating must be cleaned with solvent and refurbished from time to time. The additional coating operations raise the cost of the photoreceptor, increase manufacturing time, and decrease production throughput. Also the extra coating decreases production yield by, for example, increased likelihood that the photoreceptor will be damaged by the additional handling. Furthermore, the anticurl coating does not eliminate the built in stress and the problems that it causes, such as premature failure with cycling. Also, other difficulties have been encountered with these anti-curl coatings. For example, photoreceptor curl can sometimes still be encountered due to a decrease in anticurl layer thickness resulting from wear in as few as 1,500 imaging cycles when the photoreceptor belt is exposed to stressful operating conditions of high temperature and high humidity. The curling of the photoreceptor is inherently caused by internal stress build-up in the electrically active layer or layers of the photoreceptor which promotes dynamic fatigue cracking, thereby shortening the mechanical life of the photoreceptor. Further, the anticurl coatings occasionally separate from the substrate during extended machine cycling and render the photoconductive imaging member unacceptable for forming quality images. Anticurl layers will also occasionally delaminate due to poor adhesion to the supporting substrate. Moreover, in electrophotographic imaging systems where transparency of the substrate and anticurl layer are necessary for rear exposure erase to activating electromagnetic radiation, any reduction of transparency due to the presence of an anticurl layer will cause a reduction in performance of the photoconductive imaging member. Although the reduction in transparency may in some cases be compensated by increasing the intensity of the electromagnetic radiation, such increase is generally undesirable due to the amount of heat generated as well as the greater costs necessary to achieve higher intensity.

Further, the built in mechanical stresses which, when perturbed by wear, results in distortions which resemble ripples. These ripples are the most serious photoreceptor related problem in advanced precision imaging machines which demand precise tolerances. When ripples are present, different segments of the imaging surface of the photoconductive member are located at different distances from charging devices, developer applicators, toner image receiving members and the like during the electrophotographic imaging process thereby adversely affecting the quality of the ultimate developed images. For example, non-uniform charging distances can be manifested as variations in high background deposits during development of electrostatic latent images. It is theorized that since the anticurl backing layer is usually composed of material that is less wear resistant than the adjacent substrate layer, it wears rapidly during extended image cycling, particularly when supported by stationary skid plates. This wear is nonuniform and leads to the distortions which resemble ripples and also produces debris which can form undesirable deposits on sensitive optics, corotron wires and the like.

Another property of significance in multilayer devices is the charge carrier mobility in the transport layer. Charge carrier mobilities determine the velocities at which the photoinjected carriers transit the transport layer. To achieve maximum discharge or sensitivity for a fixed exposure, the photoinjected carriers must transit the transport layer before the imagewise exposed region of the photoreceptor arrives at the development station. To the extent the carriers are still in transit when the exposed segment of the photoreceptor arrives at the development station, the discharge is reduced and hence the contrast potentials available for development are also reduced. For greater charge carrier mobility capabilities, it is normally necessary to increase the concentration of the active small molecule transport compound dissolved or molecularly dispersed in the binder. Phase separation or crystallization sets an upper limit to the concentration of the transport molecules that can be dispersed in a binder. One way of increasing the solubility limit of the transport molecule is to attach long alkyl groups on to the transport molecules. However, these alkyl groups are "inactive" and do not transport charge. For a given concentration of the transport molecules, these side chains actually reduce the charge carrier mobility. A second factor that reduces the charge carrier mobilities is the dipole content of the charge transport molecules, their side groups as well as that of the binder in which the molecules are dispersed. One of the prior art of reducing the curl involves an imaging member comprising hole transporting material containing at least two long chain alkyl carboxylate groups dissolved or molecularly dispersed in a film forming binder. Prior art suggests the use of these molecules containing long chain alkyl carboxylate groups dispersed in a binder or in combination with a conventional hole transport molecule. However, when in combination with the conventional transport molecule, the concentration of the molecule with the long alkyl carboxylate groups has to be considerably larger than 15 weight percent in order to eliminate curl. Although curl is eliminated and these devices can be used in electrophotography, high speed electrophotography requires high charge carrier mobilities. Use of a large concentration of transporting material containing at least two long chain alkyl carboxylate groups results in a drop in mobilities because of the "inactive" long chains required to reduce curl as well as the high dipole content of these long alkyl carboxylate groups.

INFORMATION DISCLOSURE STATEMENT

U.S. Pat. No. 5,167,987 to Yu, issued Dec. 1, 1992 - A process for fabricating an electrophotographic imaging member is disclosed comprising providing a flexible substrate comprising a solid thermoplastic polymer, forming an imaging layer coating comprising a film forming polymer on the substrate, heating the coating, cooling the coating, and applying sufficient predetermined biaxial tensions to the substrate while the imaging layer coating is at a temperature greater than the glass transition temperature of the imaging layer coating to substantially compensate for all dimensional thermal contraction mismatches between the substrate and the imaging layer coating during cooling of the imaging layer coating and the substrate, removing application of the biaxial tension to the substrate, and cooling the substrate whereby the final hardened and cooled imaging layer coating and substrate are substantially free of stress and strain.

U.S. Pat. No. 4,983,481 to Yu, issued Jan. 8, 1991 - An imaging member without an anti-curl layer is disclosed having improved resistance to curling. The imaging member comprises a flexible supporting substrate layer, an electrically conductive layer, an optional adhesive layer, a charge generator layer and a charge transport layer, the supporting layer having a thermal contraction coefficient substantially identical to the thermal contraction coefficient of the charge transport layers U.S. Pat. No. 4,621,009 to Lad, issued Nov. 4, 1986 - A coating composition is disclosed for application onto a plastic film to form a coating capable of bonding with xerographic toner, The coating composition consists of a resin binder, preferably a polyester resin, a solvent for the resin binder, filler particles, and at least one crosslinking and antistatic agent. The coating composition Is applied to a polyester film, preferably a film of polyethylene terephthalate, under conditions sufficient to fix toner onto the coating without wrinkling.

U.S. Pat. No. 4,871,634 to W. Limburg at al., issued Oct. 3, 1989 - A hydroxy arylamine compound, represented by a specific formula, is disclosed as employable in photoreceptors.

CROSS REFERENCE TO COPENDING APPLICATIONS

Copending application Ser. No. 08/914,643, to D. M. Pai et al., entitled IMPROVED ELECTROPHOTOGRAPHIC IMAGING MEMBER, filed concurrently herewith Attorney Docket No. D/97309 - A flexible electrophotographic Imaging member including a supporting substrate coated with at least one Imaging layer comprising charge transport material free of long chain alkyl carboxylate groups and a small amount of a different second hole transporting material containing at least two long chain alkyl carboxylate groups dissolved or molecularly dispersed In a film forming binder and coated from a mixture of solvents containing low boiling component and a small concentration of high boiling solvent. Preferably, the flexible electrophotographic Imaging member is free of an anticurl backing layer, the imaging member comprising a supporting substrate uncoated on one side and coated on the opposite side with at least a charge generating layer and a charge transport layer containing comprising a first charge transport material and a small amount of a different second hole transporting material containing at least two long chain alkyl carboxylate groups dissolved or molecularly dispersed in a film forming binder and coated from a mixture of solvents containing low boiling component and a small concentration of high boiling solvent.

Copending application Ser. No. 08/782,236 to J. Yanus et al., entitled HIGH SENSITIVITY VISIBLE AND INFRARED PHOTORECEPTOR, filed Jan. 13, 1997, Attorney Docket No. D/95645 - A process is disclosed for fabricating an electrophotographic imaging member including providing a supporting substrate, forming a charge generating layer on the substrate, applying a coating composition to the charge generating layer, the coating composition including a film forming charge transporting polymer dissolved in methylene chloride and a solvent selected from the group consisting of 1,2 dichloroethane, 1,1,2 trichloroethane or mixtures thereof, the charge transporting polymer having a backbone comprising active arylamine moieties along which charge is transported, and drying the coating to form a charge transporting layer.

Copending application Ser. No. 08/722,352 to J. Yanus et al., filed Sep. 27, 1996, entitled ELECTROPHOTOGRAPHIC IMAGING MEMBER HAVING AN IMPROVED CHARGE TRANSPORT LAYER, Attorney Docket No. D/96193 - A flexible electrophotographic imaging member is disclosed coated with at least one imaging layer comprising a hole transporting material containing at least two long chain alkyl carboxylate groups dissolved or molecularly dispersed in a film forming binder. The imaging member may be free of an anticurl backing layer.

Thus, the characteristics of many electrophotographic imaging members comprising a supporting substrate coated on one side with at least one photoconductive layer and coated or uncoated on the other side with an anticurl layer exhibit deficiencies which are undesirable in automatic, cyclic electrophotographic copiers, duplicators, and printers.

BRIEF SUMMARY OF THE INVENTION

It is an object of the invention to provide an electrophotographic imaging member which overcomes the above-noted disadvantages.

It is another object of this invention to provide an electrophotographic imaging member process with improved resistance to curling.

It is another object of this invention to provide an electrophotographic imaging member which is less complex.

It is another object of this invention to provide an electrophotographic imaging member capable of being fabricated with a simpler coating process.

It is another object of this invention to provide an electrophotographic imaging member free of an anticurl backing layer.

It is another object of this invention to provide an electrophotographic imaging member substantially free of internal stress.

It is another object of this invention to provide an electrophotographic imaging member free of an anticurl backing layer and yet can be operated at high speed.

It is still another object of this invention to provide an electrophotographic imaging member having improved resistance to the formation of ripples in the form of crossweb sinusoidal deformations when subjected to extended image cycling.

It is another object of this invention to provide an electrophotographic imaging member exhibiting an increased cycling life.

The foregoing objects and others are accomplished in accordance with this invention by providing a flexible electrophotographic imaging member including a supporting substrate coated with at least one imaging layer comprising hole transporting material containing a hole transporting molecule dissolved or molecularly dispersed in a film forming binder and coated from a mixture of solvents comprising a low point boiling solvent and a small concentration of high boiling point solvent. Preferably, the flexible electrophotographic imaging member is free of an anticurl backing layer, the imaging member comprising a supporting substrate uncoated on one side and coated on the opposite side with at least a charge generating layer and a charge transport layer containing hole transporting material dissolved or molecularly dispersed in a film forming binder and coated from a mixture of solvents containing a low boiling point solvent and a small concentration of high boiling point solvent.

The term "substrate" is defined herein as a flexible member comprising a solid thermoplastic polymer or a metallic substrate that is uncoated or coated on the side to which a charge generating layer and a charge transport layer are to be applied and free of any anticurl backing layer on the opposite side.

Generally, the imaging member comprises a flexible supporting substrate having an electrically conductive surface and at least one imaging layer. The imaging layer may be a single layer combining the charge generating and charge transporting functions or these functions may be separated, each in its own optimized layer. The flexible supporting substrate layer having an electrically conductive surface may comprise any suitable flexible web or sheet comprising a solid thermoplastic polymer. The flexible supporting substrate layer having an electrically conductive surface may be opaque or substantially transparent and may comprise numerous suitable materials having the required mechanical properties. For example, it may comprise an underlying flexible insulating support layer coated with a flexible electrically conductive layer, or merely a flexible conductive layer having sufficient mechanical strength to support the electrophotoconductive layer or layers. The flexible electrically conductive layer, which may comprise the entire supporting substrate or merely be present as a coating on an underlying flexible web member, may comprise any suitable electrically conductive material. Typical electrically conductive materials include, for example, aluminum, titanium, nickel, chromium, brass, gold, stainless steel and the like. These conductive materials as well as others such as copper iodide, carbon black, graphite and the like may be dispersed in a solid thermoplastic polymer. The flexible conductive layer may vary in thickness over substantially wide ranges depending on the desired use of the electrophotoconductive member. Accordingly, the conductive layer can generally range in thicknesses of from about 50 Angstrom units to about 150 micrometers. When a highly flexible photoresponsive imaging device is desired, the thickness of the conductive layer may be between about 100 Angstrom units to about 750 Angstrom units. Any suitable underlying flexible support layer of any suitable material containing a thermoplastic film forming polymer alone or a thermoplastic film forming polymer in combination with other materials may be used. Typical underlying flexible support layers comprise film forming polymers include, for example, polyethylene terepthalate, polyimide, polysulfone, polyethylene naphthalate, polypropylene, nylon, polyester, polycarbonate, polyvinyl fluoride, polystyrene and the like. Specific examples of supporting substrates include polyethersulfone (Stabar S-100, available from ICI), polyvinyl fluoride (Tedlar, available from E. I. DuPont de Nemours & Company), polybisphenol-A polycarbonate (Makrofol, available from Mobay Chemical Company) and amorphous polyethylene terephthalate (Melinar, available from ICI Americas, Inc.).

The coated or uncoated flexible supporting substrate layer is highly flexible and may have any number of different configurations such as, for example, a sheet, a scroll, an endless flexible belt, and the like. Preferably, the insulating web is in the form of an endless flexible belt and comprises a commercially available biaxially oriented polyethylene terephthalate substrate known as Melinex 442, available from ICI. If desired, any suitable charge blocking layer may be interposed between the conductive layer and the photogenerating layer. Some materials can form a layer which functions as both an adhesive layer and charge blocking layer. Typical blocking layers include polyvinylbutyral, organosilanes, epoxy resins, polyesters, polyamides, polyurethanes, silicones and the like. The polyvinylbutyral, epoxy resins, polyesters, polyamides, and polyurethanes can also serve as an adhesive layer. Adhesive and charge blocking layers preferably have a dry thickness between about 20 Angstroms and about 2,000 Angstroms.

The silane reaction product described in U.S. Pat. No. 4,464,450 is particularly preferred as a blocking layer material because of excellent extended cyclic stability. The entire disclosure of U.S. Pat. No. 4,464,450 is incorporated herein by reference. Typical hydrolyzable silanes include 3-aminopropyltriethoxysilane, N-aminoethyl-3-aminopropyltrimethoxysilane, N-2-aminoethyl-3-aminopropyltrimethoxysilane, N-2-aminoethyl-3-aminopropyltris(ethylethoxy) silane, p-aminophenyl trimethoxysilane, 3-aminopropyldiethylmethylsilane, (N,N'-dimethyl 3-amino)propyltriethoxysilane, 3-aminopropylmethyldiethoxysilane, 3-aminopropyl trimethoxysilane, N-methylaminopropyltriethoxysilane, methyl [2-(3-trimethoxysilyl propyl amino)ethylamino]-3-proprionate, (N,N'-dimethyl 3-amino)propyl triethoxysilane, N,N-dimethylaminophenyltriethoxy silane, trimethoxysilylpropyidiethylenetriamine and mixtures thereof. Generally, satisfactory results may be achieved when the reaction product of a hydrolyzed silane and metal oxide layer forms a blocking layer having a thickness between about 20 Angstroms and about 2,000 Angstroms.

In some cases, intermediate layers between the blocking layer and the adjacent charge generating or photogenerating layer may be desired to improve adhesion or to act as an electrical barrier layer. If such layers are utilized, they preferably have a dry thickness between abut 0.01 micrometer to about 5 micrometers. Typical adhesive layers include film forming polymers such as polyester, polyvinylbutyral, polyvinylpyrolidone, polyurethane, polymethyl methacrylate and the like.

Typically, the electrophotoconductive imaging member of this invention comprises a supporting substrate layer, a metallic conductive layer, a charge blocking layer, an optional adhesive layer, a charge generator layer, a charge transport layer. The electrophotoconductive imaging member of this invention is preferably free of any anti-curl layer on the side of the substrate layer opposite the electrically active charge generator and charge transport layers, although a back coating may be optionally present to provide some other benefit such as increased traction and the like. Any suitable charge generating or photogenerating material may be employed as one of the two electrically operative layers in the multilayer photoconductor of this invention. Typical charge generating materials include metal free phthalocyanine described in U.S. Pat. No. 3,357,989, metal phthalocyanines such as copper phthalocyanine, quinacridones available from DuPont under the tradename Monastral Red, Monastral Violet and Monastral Red Y, substituted 2,4-diamino-triazines disclosed in U.S. Pat. No. 3,442,781, and polynuclear aromatic quinones available from Allied Chemical Corporation under the tradename Indofast Double Scarlet, Indofast Violet Lake B, Indofast Brilliant Scarlet and Indofast Orange. Other examples of charge generator layers are disclosed in U.S. Pat. No. 4,265,990, U.S. Pat. No. 4,233,384, U.S. Pat. No. 4,471,041, U.S. Pat. No. 4,489,143, 4,507,480, U.S. Pat. No. 4,306,008, 4,299,897, U.S. Pat. No. 4,232,102, U.S. Pat. No. 4,233,383, U.S. Pat. No. 4,415,639 and U.S. Pat. No. 4,439,507. The disclosures of these patents are incorporated herein by reference in their entirety.

Any suitable inactive resin binder material may be employed in the charge generator layer. Typical organic resinous binders include polycarbonates, acrylate polymers, vinyl polymers, cellulose polymers, polyesters, polysiloxanes, polyamides, polyurethanes, epoxies, and the like. Many organic resinous binders are disclosed, for example, in U.S. Pat. No. 3,121,006 and U.S. Pat. No. 4,439,507, the entire disclosures of which are incorporated herein by reference. Organic resinous polymers may be block, random or alternating copolymers. The photogenerating composition or pigment is present in the resinous binder composition in various amounts. When using an electrically inactive or insulating resin, it is important that there be particle-to-particle contact between the photoconductive particles. This necessitates that the photoconductive material be present in an amount of at least about 15 percent by volume of the binder layer with no limit on the maximum amount of photoconductor in the binder layer. If the matrix or binder comprises an active material, e.g. poly(N-vinyl carbazole), a photoconductive material need only to comprise about 1 percent or less by volume of the binder layer with no limitation on the maximum amount of photoconductor in the binder layer. Generally for generator layers containing an electrically active matrix or binder such as poly(N-vinyl carbazole) or poly(hydroxyether), from about 5 percent by volume to about 60 percent by volume of the photogenerating pigment is dispersed in about 95 percent by volume to about 40 percent by volume of binder, and preferably from about 7 percent to about 30 percent by volume of the photogenerating pigment is dispersed in from about 93 percent by volume to about 70 percent by volume of the binder. The specific proportions selected also depends to some extent on the thickness of the generator layer.

The thickness of the photogenerating binder layer is not particularly critical. Layer thicknesses from about 0.05 micrometer to about 40 micrometers have been found to be satisfactory. The photogenerating binder layer containing photoconductive compositions and/or pigments, and the resinous binder material preferably ranges in thickness of from about 0.1 micrometer to about 5 micrometers, and has an optimum thickness of from about 0.3 micrometer to about 3 micrometers for best light absorption and improved dark decay stability and mechanical properties.

Other typical photoconductive layers include amorphous or alloys of selenium such as selenium-arsenic, selenium-tellurium-arsenic, selenium-tellurium, and the like.

The charge transport layer comprises a charge transporting small molecule dissolved or molecularly dispersed in a film forming electrically inert polymer such as a polycarbonate. The term "dissolved" as employed herein is defined as forming a solution in which the small molecule is dissolved in the polymer to form a homogeneous phase. The expression "molecularly dispersed" as used herein is defined as a charge transporting small molecule dispersed in the polymer, the small molecules being dispersed in the polymer on a molecular scale. Any suitable charge transporting or electrically active small molecule may be employed in the charge transport layer of this invention. The expression charge transporting "small molecule" is defined herein as a monomer that allows the free charge photogenerated in the transport layer to be transported across the transport layer. Typical charge transporting small molecules include, for example, pyrazolines such as 1-phenyl-3-(4'-diethylamino styryl)-5-(4"- diethylamino phenyl)pyrazoline, diamines such as N,N'-diphenyl-N,N'-bis(3-methylphenyl)-(1,1'-biphenyl)-4,4'-diamine, hydrazones such as N-phenyl-N-methyl-3-(9-ethyl)carbazyl hydrazone and 4-diethyl amino benzaldehyde-1,2-diphenyl hydrazone, and oxadiazoles such as 2,5-bis (4-N,N'-diethylaminophenyl)-1,2,4-oxadiazole, stilbenes and the like. However, to avoid cycle-up, the charge transport layer should be substantially free of triphenyl methane. As indicated above, suitable electrically active small molecule charge transporting compounds are dissolved or molecularly dispersed in electrically inactive polymeric film forming materials. A preferred small molecule charge transporting compound that permits injection of holes from the pigment into the charge generating layer with high efficiency and transports them across the charge transport layer with very short transit times is N,N'-diphenyl-N,N'-bis(3-methylphenyl)-(1,1'-biphenyl)-4,4'-diamine.

Any suitable electrically inactive resin binder soluble in the solvent mixture used may be employed to form the charge transport layer. Typical inactive resin or polymeric binders include, for example, polycarbonate resin, polyester, polyarylate, polyacrylate, polyether, polysulfone, and the like. Weight average molecular weights of these binders can vary, for example, from about 20,000 to about 150,000. A preferred electrically inert polymeric binder used to disperse the electrically active molecule in the charge transport layer is poly(4,4'-isopropylidene-diphenylene)carbonate (also referred to as bisphenol-A-polycarbonate).

A mixture of low boiling point and high boiling point solvents is employed to form the transport layer of this invention. Methylene chloride solvent is a desirable low boiling point component of the charge transport layer coating mixture for adequate dissolving of all the components and for its low boiling point. Because of the low boiling point of methylene chloride, it is easily removed during drying. The expression "low boiling solvent", as employed herein, is defined as those solvents having a boiling point which is at least about 10° C. lower than the typical drying temperature in the range of about 80° C. to about 125° C. The phrase "high boiling solvent", as employed herein, is defined as those solvents having a boiling point which is about equal to the drying temperature or slightly or substantially higher than the drying temperature. The high boiling point component in the solvent mixture for coating the transport layer is selected from the group consisting of monochlorobenzene, dichlorobenzene, trichlorobenzene, and mixtures thereof. The mixtures thereof may comprise any two or all three of the high boiling solvents. Because these solvents have a high boiling point, they evaporate slowly. The high and low boiling point solvents should be miscible in each other and should also dissolve the film forming binder and charge transporting molecule. Since the concentration of the high boiling point solvent employed depends on the boiling point of the specific high boiling point solvent selected, the concentration of the high boiling point solvent in the coating mixture is adjusted for any combination of specific high and low boiling point solvents until it forms a transport layer that is substantially free of internal stress. The expression "substantially free of internal stress" as employed herein is defined as lacking in unbalanced internal forces in the bulk which leads to physical distortion of materials in the transport layer. A photoreceptor comprising a transport layer free of internal stress on a supporting substrate layer will lie flat and be free of curl. Unlike prior doping of a transport layer with a molecule containing long chain alkyl carboxylate groups, there is no reduction in the charge carrier mobility when the transport layer is coated from a mixture of low boiling point and high boiling point solvents. Thus, for example, in a transport layer containing 50 percent by weight of the transport molecule of a diamine dispersed in a binder, based on the total weight of the transport layer, the amount of the high boiling point solvent required to produce stress free, curl free devices should be from about 4 percent by weight to about 12 percent by weight, based on the total weight of the solvents employed, depending on the boiling point of the specific high boiling point solvent employed. The boiling point of methylene chloride is 40° C. and the boiling point of monochlorobenzene, dichlorobenzene and 1,2, 4 trichlorobenzene are 131° C., 173° C. and 213° C., respectively. In order to achieve stress free films, the concentration of monochlorobenzene is from about 10 to 12 percent by weight and the concentration of 1,2, 4 trichlorobenzene is from about 4 to 6 percent by weight, based on the total weight of the "low boiling point solvent" in the coating mixture. Thus, the transport layer coating mixture should contain at least about 4 percent by weight of the chlorobenzene solvent, based on the total weight of the solvents, the amount of chlorobenzene being sufficient to form a transport layer that is substantially free of internal stress. The concentration of the dichlorobenzene in the coating mixture lies between about 4 percent and about 12 percent by weight. The concentration of about 4 percent to 12 percent by weight of the "high boiling point solvent" (based on the weight of the total weight of the solvents in the coating mixture) is for a material composition containing 50 weight percent N,N'-diphenyl-N,N'-bis(3-methylphenyl)-(1,1'-biphenyl)-4,4' diamine in bisphenol-A-polycarbonate. The concentration of the "high boiling point solvent" in the coating mixture depends on the glass transition temperature of the material composition of the transport layer in the absence of the "high boiling solvent".

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like. Preferably, the drying temperature should be lower than or equal to the boiling point of the "high boiling point solvent" and higher than the boiling point of the "low boiling point solvent". Generally, the thickness of the dried transport layer is between about 5 micrometers to about 100 micrometers, but thicknesses outside this range can also be used. Not all of the "high boiling point solvent" added to the coating mixture remains in the final "dried" film. The amount of the "high boiling point solvent" remaining in the final "dried" device depends on several factors including: (1) drying temperature, (2) boiling point of the "high boiling point solvent", (3) concentration of the "high boiling point solvent" in the coating mixture and (4) transport layer thickness. However, every dried photoreceptor of this invention must contain at least about some residual "high boiling point solvent" from the original coating solution after drying. The glass transition temperature of the "dried" film is lowered as a result of employing the "high boiling point solvent" in the coating solution. Since some of the "high boiling solvent" remains as residual solvent in the dried transport layer, a measure of the relative amount of residual solvent is the altered glass transition temperature. In order to obtain curl free devices, the glass transition temperature should be lower than about 55° C., preferably lower than about 45° C. For a transport layer containing 50 weight percent N,N'-diphenyl-N,N'-bis(3-methylphenyl)-(1,1'-biphenyl)-4,4' diamine (based on the total weight of the solids in the coating solution) in bisphenol-A-polycarbonate coated without the "high boiling point solvent", the glass transition temperature is approximately 73° C. When coated with the "high boiling point solvent" (and with the concentration of "high boiling point solvent" required to form flat, "curl free" devices), the glass transition temperature transport layer is between about 40° and about 45° C. Thus, the dried transport layer has a glass transition temperature of between about 40° C. and about 55° C. and, more preferably has a glass transition temperature of between about 40° C. and about 45° C.

The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer to the charge generator layer is preferably maintained from about 2:1 to 200:1 and in some instances as great as 400:1.

Optionally, a thin overcoat layer may also be utilized to improve resistance to abrasion. These overcoating layers may comprise organic polymers or inorganic polymers that are electrically insulating or slightly semi-conductive.

PREFERRED EMBODIMENTS OF THE INVENTION

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

Six flexible photoreceptor sheets were prepared by forming coatings using conventional techniques on a substrate comprising a vacuum deposited titanium layer on a flexible polyethylene terephthalate film having a thickness of 3 mil (76.2 micrometers). The first coating was a siloxane barrier layer formed from hydrolyzed gamma aminopropyltriethoxysilane having a thickness of 0.005 micrometer (50 Angstroms). This layer was coated from a mixture of 3-aminopropyltriethoxysilane (available from PCR Research Chemicals of Florida) in ethanol in a 1:50 volume ratio. The coating was applied to a wet thickness of 0.5 mil by a multiple clearance film applicator. The coating was then allowed to dry for 5 minutes at room temperature, followed by curing for 10 minutes at 110 degrees centigrade in a forced air oven. The next applied coating was an adhesive layer of polyester resin (49,000, available from E. I. duPont de Nemours & Co.) having a thickness of 0.005 micrometer (50 Angstroms) and was coated from a mixture of 0.5 gram of 49,000 polyester resin dissolved in 70 grams of tetrahydrofuran and 29.5 grams of cyclohexanone. The coating was applied by a 0.5 mil bar and cured in a forced air oven for 10 minutes. This adhesive interface layer was thereafter coated with a photogenerating layer (CGL) containing 40 percent by volume hydroxygallium phthalocyanine and 60 percent by volume copolymer polystyrene (82 percent)/poly-4 -vinyl pyridine (18 percent) with a Mw of 11,000. This photogenerating coating mixture was prepared by introducing 1.5 grams polystyrene/poly-4-vinyl pyridine and 42 ml of toluene into a 4 oz. amber bottle. To this solution was added 1.33 grams of hydroxygallium phthalocyanine and 300 grams of ⅛ inch diameter stainless steel shot. This mixture was then placed on a ball mill for 20 hours. The resulting slurry was thereafter applied to the adhesive interface with a Bird applicator to form a layer having a wet thickness of 0.25 ml. The layer was dried at 135° C. for 5 minutes in a forced air oven to form a dry thickness photogenerating layer having a thickness of 0.4 micrometer.

Eight coated members prepared as described above were coated with charge transport layers containing N,N'- diphenyl-N,N'-bis(3-methyl-phenyl)-(1,1'biphenyl)-4,4'-diamine (TBD) molecularly dispersed in a polycarbonate resin [poly(4,4'-isopropylidene-diphenylene) carbonate available as Makrolon® from Farbenfabricken Bayer A. G.]. Each transport layer was formed from a coating composition with methylene chloride containing different amounts of mono, di or 1,2, 4 trichlorobenzene as shown in Table 1. First, 1.2 grams of polycarbonate polymer was dissolved in 13.2 grams of the total solvent to form a polymer solution and 1.2 grams of N,N'-diphenyl-N,N'-bis(3-methyl-phenyl)-(1,1'biphenyl)-4,4'-diamine (TBD) was dissolved in the polymer solution. The charge transport layer coatings were formed using a Bird coating applicator. The N,N'-diphenyl-N,N'-bis(3-methyl-phenyl)-(1,1'biphenyl)-4,4'-diamine (TBD) is an electrically active aromatic diamine charge transport small molecule whereas the polycarbonate resin is an electrically inactive film forming binder. Each of the coated devices were dried at 80° C. for half an hour in a forced air oven to form a 25 micrometer thick charge transport layer on the coated members. The compositions of six transport layers on the coated members and the amount of mono, di or 1,2,4 trichlorobenzene used to coat the transport layers are shown in Table 1 below:

TABLE 1

| Device # | Polycarbonate | TBD | Methylene chloride concentration (wt %) | MCB, DCB or TCB (wt %) |
|---|---|---|---|---|
| 1 | 1.2 grams | 1.2 grams | 100.0% | 0.0% (MCB) |
| 2 | 1.2 grams | 1.2 grams | 92.3% | 7.7% (MCB) |
| 3 | 1.2 grams | 1.2 grams | 88.5% | 11.5% (MCB) |
| 4 | 1.2 grams | 1.2 grams | 84.6% | 15.4% (MCB) |
| 5 | 1.2 grams | 1.2 grams | 94.0% | 6.0% (DCB) |
| 6 | 1.2 grams | 1.2 grams | 92.0% | 8.0% (DCB) |
| 7 | 1.2 grams | 1.2 grams | 97.0% | 3.0% (TCB) |
| 8 | 1.2 grams | 1.2 grams | 94.0% | 6.0% (TCB) |

EXAMPLE II

The six flexible photoreceptor sheets prepared as described in Example I were tested for flatness by placing them in an unrestrained condition on a flat surface: (a) Device #1 had the most curl, device #2 had less curl but was still not flat, devices # 3 and # 4 were flat; (b) device # 5 had less curl than device #1 was not flat whereas device # 6 was flat; (c) device # 7 had less curl than device #1 yet was not flat whereas device # 8 was flat.

EXAMPLE III

The flexible photoreceptor sheets prepared as described in Example I were tested for xerographic sensitivity and cyclic stability. Each photoreceptor sheet to be evaluated was mounted on a cylindrical aluminum drum substrate which was rotated on a shaft. The photoreceptor was charged by a corotron mounted along the periphery of the drum. The surface potential was measured as a function of time by capacitively coupled voltage probes placed at different locations around the shaft. The probes were calibrated by applying known potentials to the drum substrate. Each photoreceptor sheet on the drum was exposed by a light source located at a position near the drum downstream from the corotron. As the drum was rotated, the initial (pre exposure) charging potential was measured by voltage probe 1. Further rotation lead to the exposure station, where the photoreceptor device was exposed to monochromatic radiation of known intensity. The device was erased by a light source located at a position upstream of charging. The measurements made included charging of the photoconductor device in a constant current or voltage mode. The device was charged to a negative polarity. As the drum was rotated, the initial charging potential was measured by voltage probe 1. Further rotation lead to the exposure station, where the photoreceptor device was exposed to monochromatic radiation of known intensity. The surface potential after exposure was measured by voltage probes 2 and 3. The device was finally exposed to an erase lamp of appropriate intensity and any residual potential was measured by voltage probe 4. The process was repeated with the magnitude of the exposure automatically changed during the next cycle. The photodischarge characteristics was obtained by plotting the potentials at voltage probes 2 and 3 as a function of light exposure. The charge acceptance and dark decay were also measured in the scanner. The Photoinduced Discharge characteristics (PIDC) and the cyclic stability of all the eight devices were essentially equivalent.

EXAMPLE IV

Charge carrier mobilities were measured as follows in the eight photoreceptors of Example I. A vacuum chamber was employed to deposit a semitransparent gold electrode on top of each photoreceptor. The resulting sandwich device was connected to an electrical circuit containing a power supply and a current measuring resistance. The transit time of the charge carriers was determined by the time of flight technique. This was accomplished by biasing the gold electrode negative and exposing the device to a brief flash of light. Holes photogenerated in the generator layer of hydroxy gallium phthalocyanine generator layers were injected into and transited through the transport layer. The current due to the transit of a sheet of holes was time resolved and displayed on an oscilloscope. The current pulse displayed on the oscilloscope comprised a curve having flat segment followed by a rapid decrease. The flat segment was due to the transit of the sheet of holes through the transport layer. The rapid drop of current signaled the arrival of the holes at the gold electrode. From the transit time, the velocity of the carriers was calculated by the relationship:

velocity=transport layer thickness/transit time

The hole mobility is related to the velocity by the relationship:

velocity=(mobility)×(electric field)

The mobility of the eight photoreceptors at an applied electric field of 2×105 V/cm is approximately 1×10−5 $cm^2$/Vsec and to a first approximation is not dependent on the solvent.

Example V 40 micron thick transport layers containing N,N'-diphenyl-N,N'-bis(3-methyl-phenyl)-(1,1'biphenyl)-4,4'-diamine (TBD) molecularly dispersed in a polycarbonate resin [poly(4,4'-isopropylidene-diphenylene) carbonate available as Makrolon® from Farbenfabricken Bayer A. G.]. were coated on a Mylar® film substrate. Each transport layer was formed from a coating composition with methylene chloride containing different amounts of 1,2, 4 trichlorobenzene as shown in Table 2. First, 1.2 grams of polycarbonate polymer was dissolved in 13.2 grams of the total solvent to form a polymer solution and 1.2 grams of N,N'-diphenyl-N,N'-bis(3-methyl-phenyl)-(1,1'biphenyl)-4,4'-diamine (TBD) was dissolved in the polymer solution. The charge transport layer coatings were formed using a Bird coating applicator. Each of the coated devices was dried at 80° C. for half an hour in a forced air oven to form a 40 micrometer thick charge transport layer on the Mylar® substrate. The transport layers were delaminated and the glass transition temperature measured employing differential scanning calorimetry (DSC). The compositions of the transport layers on the coated members and the amount of 1,2,4 trichlorobenzene used to coat the transport layers are shown in Table 2 below:

TABLE 2

| Device # | Poly-carbonate | TBD | Methylene chloride Composition (wt %) | 1,2,4 trichloro-benzene composition (wt %) | Glass Transition Tempera-ture ($T_g$ °C.) |
|---|---|---|---|---|---|
| 9 | 1.2 grams | 1.2 grams | 100 | 0 | 72.9° C. |
| 10 | 1.2 grams | 1.2 grams | 99 | 1 | 58.6° C. |
| 11 | 1.2 grams | 1.2 grams | 98 | 2 | 51.0° C. |
| 12 | 1.2 grams | 1.2 grams | 97 | 3 | 43.1° C. |
| 13 | 1.2 grams | 1.2 grams | 96 | 4 | 42.3° C. |

Although the invention has been described with reference to specific preferred embodiments, it is not intended to be limited thereto, rather those having ordinary skill in the art will recognize that variations and modifications may be made therein which are within the spirit of the invention and within the scope of the claims.

What is claimed is:

1. An electrophotographic imaging member comprising a substrate and at least one imaging layer comprising electrically active charge transporting molecules dissolved or molecularly dispersed in an electrically inactive polymer binder and a high boiling point solvent, the imaging layer having been formed by drying a coating at a drying temperature of between about 80° C. and about 125° C. said coating comprising a solution of said charge transporting molecules, said electrically inactive polymer binder and a mixture of a low boiling point solvent which boils at a temperature of at least about 10° C. lower than said drying temperature and a high boiling point solvent which boils at a temperature at or above said drying temperature.

2. An electrophotographic imaging member according to claim 1 wherein said film forming binder comprises a polycarbonate.

3. An electrophotographic imaging member according to claim 1 wherein said charge transporting molecule is N,N'-diphenyl-N,N'-bis(3-methyl-phenyl)-(1,1'biphenyl)-4,4'-diamine.

4. An electrophotographic imaging member according to claim 1 wherein the said low boiling point solvent is methylene chloride.

5. An electrophotographic imaging member according to claim 1 wherein the said high boiling point solvent is selected from the group consisting of monochlorobenzene, dichlorobenzene, 1,2, 4 trichlorobenzene and mixtures thereof.

6. An electrophotographic imaging member according to claim 5 wherein the concentration of said high boiling solvent is 4 to 12 percent by weight, based on the total weight of solvents.

7. An electrophotographic imaging member according to claim 1 wherein said supporting substrate comprises polyethylene terephthalate.

8. An electrophotographic imaging member according to claim 1 wherein said imaging layer is substantially free of internal stress.

9. An electrophotographic imaging member according to claim 1 wherein said supporting substrate is uncoated on one side and coated on the opposite side with said least one imaging layer.

10. An electrophotographic imaging member comprising a substrate, a charge generating layer, a charge transport layer comprising electrically active charge transporting molecules dissolved or molecularly dispersed in an electrically inactive polymer binder and a high boiling point solvent, the transport layer having been formed by drying at a drying temperature of between about 80° C. and about 125° C. a coating comprising a solution of said charge transporting molecules and said electrically inactive polymer binder in a mixture of said low boiling point solvent and said high boiling point solvent, said low boiling point solvent having a boiling point of at least about 10° C. lower than said drying temperature and said high boiling point solvent having a boiling point at or above said drying temperature.

11. An electrophotographic imaging member according to claim 10 wherein said charge transport layer has a thickness of between about 5 micrometers and about 50 micrometers.

12. An electrophotographic imaging member according to claim 10 wherein said transport layer after drying has a glass transition temperature of between about 40° C. and about55° C.

13. An electrophotographic imaging member according to claim 12 wherein said transport layer after drying has a glass transition temperature of between 40° C. about 45° C.

14. A process for fabricating an electrophotographic imaging member comprising providing a substrate, forming a charge generating layer on said substrate, and applying to said charge generating layer a coating comprising a solution of electrically active charge transporting molecules, an electrically inactive polymer binder, a low boiling point solvent and a high boiling point solvent, and drying said coating at a drying temperature of between about 80° C. and about 125° C. to form a dried charge transport layer comprising said electrically active charge transporting molecules dissolved or molecularly dispersed in said electrically inactive polymer binder and sufficient high boiling point solvent from said coating solution after drying wherein said transport layer after drying has a glass transition temperature of between about 40° C. and about 55° C., said low boiling point solvent having a boiling point temperature of at least about 10°0 C. lower than said drying temperature and said high boiling point solvent having a boiling point temperature at or above said drying temperature.

15. A process according to claim 14 wherein said low boiling point solvent is methylene chloride.

16. A process according to claim 14 wherein said high boiling point solvent is selected from the group consisting of monochlorobenzene, dichlorobenzene, 1,2, 4 trichlorobenzene and mixtures thereof.

17. A process according to claim 14 wherein said substrate is uncoated on one side, coated on the opposite side with said charge generating layer and said charge transport layer, and said imaging member after said drying lies flat on a flat surface when said imaging member is in an unrestrained condition.

18. A process according to claim 14 wherein said high boiling point solvent is selected from the group consisting of monochlorobenzene, dichlorobenzene, 1,2,4 trichlorobenzene and mixtures thereof.

19. A process according to claim 18 wherein said coating comprises between about 4 percent and about 12 percent by weight of said high boiling point solvent, based on the total weight of said mixture of said low boiling point solvent and said high boiling point solvent.

* * * * *